US009986610B1

(12) United States Patent
Loomis et al.

(10) Patent No.: US 9,986,610 B1
(45) Date of Patent: May 29, 2018

(54) LONG-CHAIN-TOLERANT DECORATIVE STRINGS OF INDEPENDENTLY ILLUMINATION CONTROLLABLE LEDS

(71) Applicant: Seasons 4, Inc., Toano, VA (US)

(72) Inventors: Jason Loomis, Decatur, GA (US); Jared William Everline, Atlanta, GA (US)

(73) Assignee: Seasons 4, Inc., Toano, VA (US)

( * ) Notice: Subject to any disclaimer, the term of this patent is extended or adjusted under 35 U.S.C. 154(b) by 0 days. days.

(21) Appl. No.: 15/484,847

(22) Filed: Apr. 11, 2017

(51) Int. Cl.

| | |
|---|---|
| ***H05B 33/08*** | (2006.01) |
| ***F21V 23/06*** | (2006.01) |
| ***F21V 23/02*** | (2006.01) |
| *F21Y 103/10* | (2016.01) |
| *F21Y 115/10* | (2016.01) |
| *F21Y 113/13* | (2016.01) |

(52) U.S. Cl.
CPC ..... *H05B 33/0845* (2013.01); *F21V 23/02* (2013.01); *F21V 23/06* (2013.01); *H05B 33/0857* (2013.01); *F21Y 2103/10* (2016.08); *F21Y 2113/13* (2016.08); *F21Y 2115/10* (2016.08)

(58) Field of Classification Search
CPC ..... H05B 33/08; H05B 33/0845; H05B 33/0857; F21V 23/02; F21V 23/06; F21Y 2103/10; F21Y 2113/13; F21Y 2115/10
USPC .... 315/129–134, 185 R, 150–152, 291, 307, 315/308, 312
See application file for complete search history.

(56) References Cited

U.S. PATENT DOCUMENTS

| | | | | |
|---|---|---|---|---|
| 8,217,587 | B2 | 7/2012 | Sauerlaender | |
| 8,450,950 | B2 | 5/2013 | McRae | |
| 8,807,796 | B2 * | 8/2014 | Li | H05B 33/0803 315/312 |
| 8,941,312 | B2 | 1/2015 | McRae | |
| 8,988,013 | B2 | 3/2015 | McRae | |
| 9,007,000 | B2 | 4/2015 | Szczeszynski et al. | |
| 9,089,030 | B2 | 7/2015 | Neuman | |
| 9,258,861 | B2 | 2/2016 | Chu et al. | |
| 9,313,846 | B2 | 4/2016 | Chen et al. | |
| 9,374,857 | B2 | 6/2016 | McRae | |
| 2014/0035481 | A1 | 2/2014 | Peting et al. | |
| 2015/0084515 | A1 | 3/2015 | Altamura et al. | |

(Continued)

*Primary Examiner* — Jimmy Vu
(74) *Attorney, Agent, or Firm* — Kinney & Lange, P.A.

(57) ABSTRACT

Apparatus and associated methods relate to a series-connectable decorative light string. High-voltage power is received via a first electrical connector at a first end of the decorative light string and is conducted to a complementary second electrical connector at a second end of the decorative light string. The decorative light string has a power converter that converts the received high-voltage power to low-voltage DC power for consumption by a plurality of lighting elements distributed along the decorative light string. Each of the plurality of lighting elements has an illumination controller. The plurality of lighting elements is wired in daisy chain fashion from the first electrical connector to the second electrical connector via data-in and data-out ports of each lighting element. The wire high-voltage power received by the first electrical connector can provide power to additional decorative light strings connected via the second electrical connector without resulting in degraded illumination.

23 Claims, 5 Drawing Sheets

(56) References Cited

U.S. PATENT DOCUMENTS

2015/0359066 A1* 12/2015 Loomis ..... A47G 33/06
362/123

* cited by examiner

LONG-CHAIN-TOLERANT DECORATIVE STRINGS OF INDEPENDENTLY ILLUMINATION CONTROLLABLE LEDS

BACKGROUND

Decorative light strings are used to communicate a joy of a holiday season, to draw attention to merchandise, or to simply decorate or adorn an object. Decorative light strings can be used both indoors and outdoors. Decorative light strings have been used residentially to adorn trees, shrubs, and houses. Commercial businesses can use decorative light strings to provide festive atmospheres at their places of business.

Some such decorations can involve many decorative light strings. These light strings are often connected in series fashion. Series-connected decorative light strings receive their operating power from a connector at a first end and deliver power to strings connected to a second end of the decorative light string. Thus, a first decorative light string in a series-connected chain of decorative light strings carries the operating current for the entire series-connected chain of decorative light strings. Conversely, a last decorative light string in the series-connected chain will only carry the operating current for that last decorative light string.

Light strings traditionally have been constructed using incandescent bulbs. Light strings that use incandescent bulbs often have been powered using AC line voltages. In more recently times, Light Emitting Diodes (LED) have been used in light strings. LEDs usually require low-voltage DC power for illumination. Therefore, decorative light strings that use LEDs can be powered by low-voltage power levels. Providing a low-voltage power level to a series-connected chain of decorative light strings, however, can result in high current levels. Such high current levels can cause voltage droop along the series-connected chain, which in turn can cause the LEDs of the last decorative light string to be noticeably dimmer than the LEDs of the first decorative light string. Thus, a method of providing power to long chains of series-connected LED light strings that minimizes the dimming of the last decorative light string of the chain is desired.

SUMMARY

Apparatus and associated methods relate to a decorative light sting. The decorative light string includes a first electrical connector located at a first end of the decorative light string. The first electrical connector has first, second, and third contacts. The first electrical connector, when plugged into a power source, is configured to receive high-voltage operating power on the first and second contacts. The first electrical connector, when plugged into a data source, is configured to receive light-control data on the third contact. The decorative light string includes a second electrical connector at a second end of the decorative light string. The second electrical connector has first, second, and third contacts. The second electrical connector, when one or more additional decorative light strings are connected thereto, is configured to provide high-voltage operating power on the first and second contacts and to provide light-control data on the third contact. The decorative light string includes a first conductor extending from the first contact of the first electrical connector to the first contact of the second electrical connector. The decorative light string includes a second conductor extending from the second contact of the first electrical connector to the second contact of the second electrical connector. The decorative light string includes a power converter configured to convert the high-voltage operating power received by the first and second contacts of the first electrical connector and supplied to the first and second conductors to a low-voltage DC operating power supplied to first and second low-voltage power conductors. The decorative light string includes a plurality of lighting elements distributed along the decorative light string, the plurality of lighting elements wired in parallel between the first and second low-voltage power conductors so as to receive the low-voltage DC operating power. Each of the plurality of lighting elements has a data-in port and a data-out port. The plurality of lighting elements are wired in a daisy-chain fashion via the data-in and data-out ports from the data-in pin of the first electrical connector to the data-out pin of the second electrical connector.

Some embodiments relate to a method of providing power and data to one or more serially-connected light stings. The method includes receiving high-voltage operating power on first and second power-in contacts of a first connector of a decorative light string. The method includes receiving data on a data-in contact of a first connector. The method includes providing the received high-voltage operating power on the first and second power-out contacts of a second connector of the light string. The method includes providing data on the data-out contact of the second connector. The method includes converting the high-voltage operating power received by the first and second power-in contacts to a low-voltage DC operating power. The method includes providing the converted low-voltage DC operating power to each of a plurality of lighting elements. The method includes independently controlling illumination of a plurality of lighting elements distributed along the decorative light string.

Some embodiments relate to a decorative light sting including first and second electrical connectors located at first and second ends, respectively, of the decorative light string. Each of the first and second electrical connectors has first, second, and third contacts. The decorative light string includes first and second conductors extending from the first and second contacts of the first electrical connector to the first and second contacts of the second electrical connector, respectively. The decorative light string includes a power converter configured to convert a high-voltage operating power received by the first and second contacts of the first electrical connector and supplied to the first and second conductors to a low-voltage DC operating power. The decorative light string includes a plurality of lighting elements distributed along the decorative light string receiving the low-voltage DC operating power and wired in daisy chain fashion from the third contact of the first electrical connector to the third contact of the second electrical connector via a data-in and a data-out port of each lighting element.

DETAILED DESCRIPTION

Apparatus and associated methods relate to a series-connectable decorative light string. High-voltage power is received via a first electrical connector at a first end of the decorative light string and is conducted to a complementary second electrical connector at a second end of the decorative light string. The decorative light string has a power converter that converts the received high-voltage power to low-voltage DC power for consumption by a plurality of lighting elements distributed along the decorative light string. Each of the plurality of lighting elements has an illumination controller. The plurality of lighting elements is wired in daisy chain fashion from the first electrical connector to the second electrical connector via data-in and data-out ports of each lighting element. The wire high-voltage power received by the first electrical connector can provide power to additional decorative light strings connected via the second electrical connector without resulting in degraded illumination.

Figure 1:
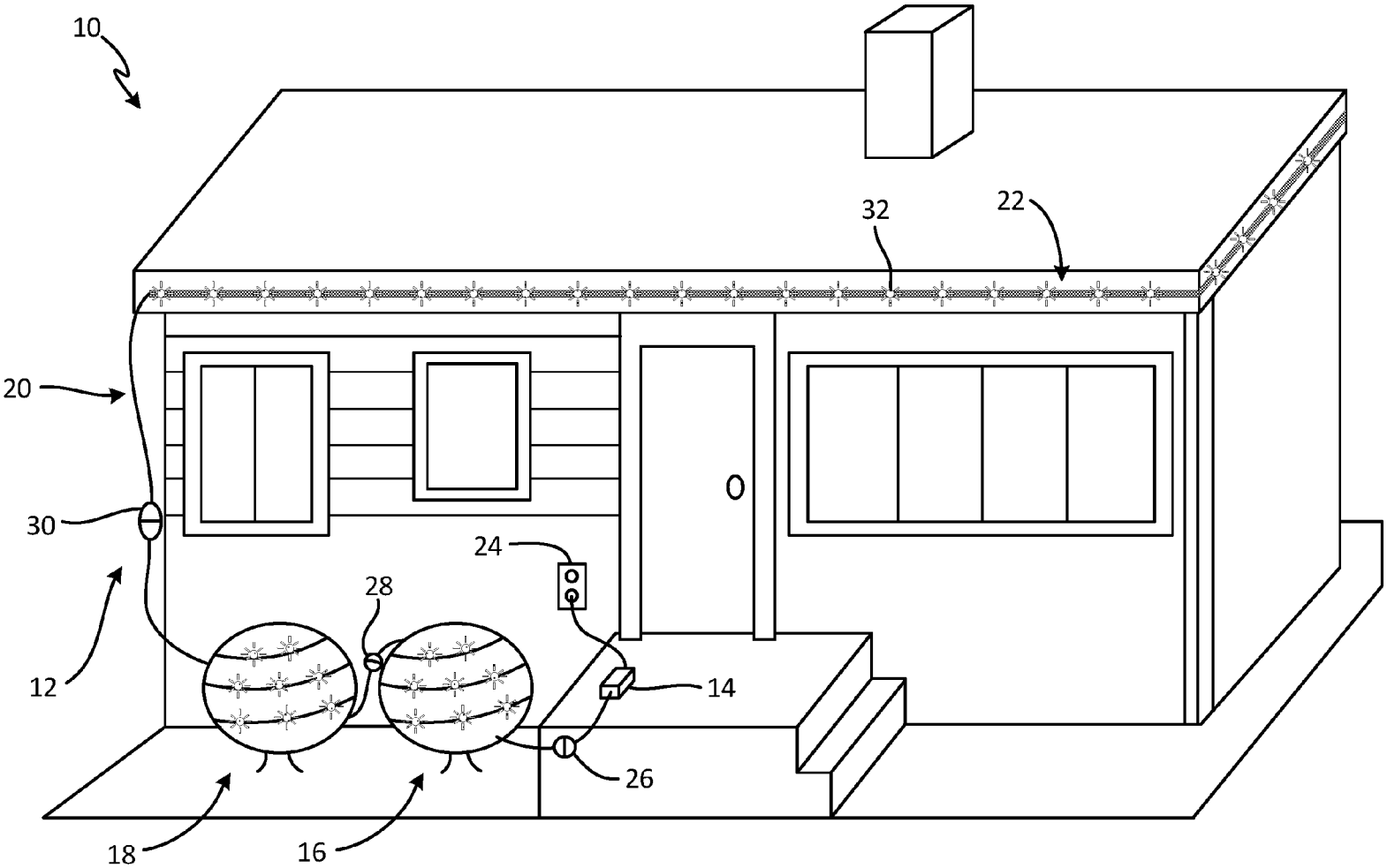
FIG. 1 is a schematic view of a home decorated with long chain of series-connected decorative light strings.

FIG. 1 is a schematic view of a home decorated with long chain of series-connected decorative light strings. In FIG. 1, home 10 is decorated with lighting system 12 for a holiday season. Lighting system 12 includes a power supply 14 and decorative LED light strings 16, 18, 20 and 22. Power supply 14 is plugged into house outlet 24 and draws operating current from standard AC line voltage (e.g., 120 VAC). Decorative light strings 16, 18, 20 and 22 are series connected. First decorative LED light string 16 is connected to power supply 14 via connector pair 26. Second decorative LED light string 18 is connected to first decorative LED light string 16 via connector pair 28. Third decorative LED light string 20 is connected to second decorative LED light string 18 via connector pair 30. Fourth decorative LED light string 22 is connected to third decorative LED light string 20 via connector pair 32. Each of connector pairs 26, 28, 30 and 32 include a connector coupled to a first of the connected elements (e.g., a connector of power supply 14), and a complementary connector coupled to a second of the connected elements (e.g., a connector of first decorative light string 16).

Operating power for decorative LED light strings 16, 18, 20 and 22 is provided by power supply 14. In some embodiments, power supply 14 converts power from standard AC line voltage to a form compatible with LED light strings 16, 18, 20 and 22. For example, in an exemplary embodiment power supply 14 converts 120 VAC power to high-voltage DC power. In other embodiments, however, decorative light strings 16, 18, 20 and 22 can be made to be compatible with 120 VAC. In such embodiments, power supply 14 can be omitted, and first decorative LED light string 16 can be directly plugged into house outlet 24. Regardless of the specific power configuration, the chain of series-connected decorative LED light strings 16, 18, 20 and 22 is supplied operating power, both voltage and current, through the connector of connector pair 26 that is coupled to first decorative LED light string 16.

All operating current for decorative LED light strings 16, 18, 20 and 22 will be conducted through connector pair 26 in lighting system 12 as depicted in FIG. 1. Connector pair 28 will conduct operating current for decorative LED light strings 18, 20 and 22. Connector pair 30 will conduct operating current for decorative LED light strings 20 and 22. Connector pair 32 will conduct operating current only for decorative LED light strings 22. Operating power for decorative LED light strings 16, 18, 20 and 22 is calculated as the product of the operating voltage and the operating current. Thus, a specific operating power can be achieved using different voltages and currents. For example, a first power configuration may use high operating current and low operating voltage to achieve a specific operating power, while a second power configuration may use a lower operating current a higher operating voltage.

Although both the first and second power configurations achieve the same operating power, the current differences can have secondary consequence. Because the operating current for light strings 16, 18, 20 and 22 is conducted through connector pair 26, a voltage drop will occur across connector pair 26, as connector pair 26 has a non-zero parasitic resistance associated with connector pair 26. Furthermore, a voltage drop will occur across both decorative LED light sting 16 and connector pair 28 due to parasitic resistances, as a result of conduction therethrough of operating current for lights strings 18, 20 and 22. The first power configuration, which achieves the specific operating power using high operating currents will have larger voltage drops across lighting elements 26, 16, 28, etc. than will the second power configuration which achieves the same specific operating power but uses lower operating currents. Use of high-voltage/low-current power configurations can permit the use of long chains of series-connected decorative LED light strings.

Figure 2:
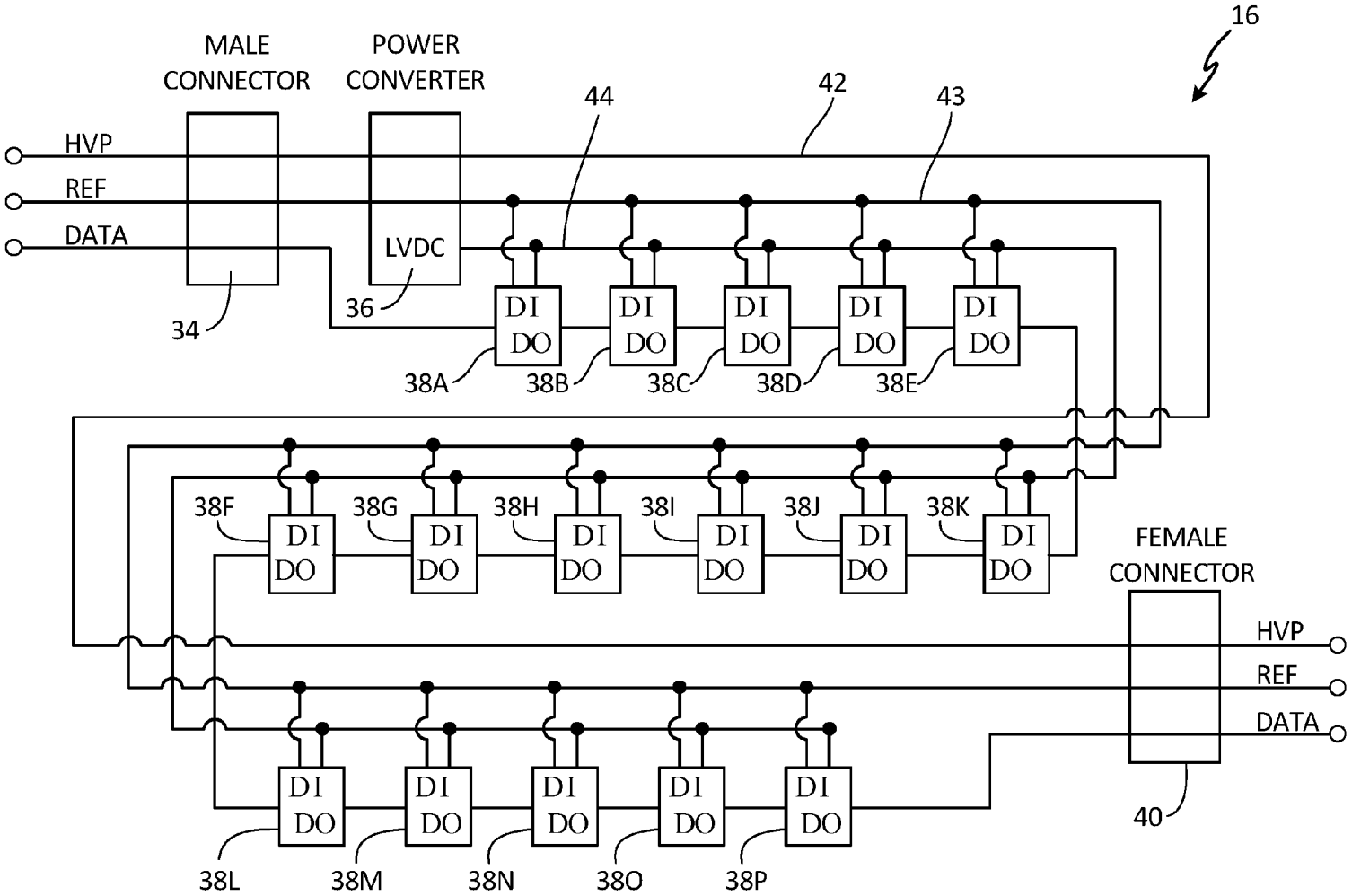
FIG. 2 is a schematic diagram of an exemplary long-chain-tolerant decorative LED light string.

FIG. 2 is a schematic diagram of an exemplary long-chain-tolerant decorative LED light string. In FIG. 2, decorative LED light string 16 of FIG. 1 is shown in schematic form. Decorative LED light string 16 includes first connector 34, power converter 36, lighting elements 38A-38P, and second connector 40. First connector 34 is labeled as MALE CONNECTOR, and second connector 40 is labeled as FEMALE CONNECTOR in the depicted embodiment. Various embodiments can have various configurations of connectors. To facilitate series connectivity of multiple decorative LED light stings, however, first connector 34 and second connector 40 are complementary connectors. Connectors are complementary when they mate or engage with one another. Thus, first connector 34 of a subsequent and decorative LED light string (and perhaps identical to decorative LED light string 16, e.g., decorative light string 18 depicted in FIG. 1) can mate or engage with second connector 40 of decorative LED light string 16 depicted in FIGS. 1 and 2, if first connector 34 and second connector 40 are complementary to one another.

In the depicted embodiment connectors 34 and 40 each has three contacts. First connector 34 has contacts labeled: i) high-voltage power HVP; ii) power reference REF; and iii) and data-in DATA. Second connector 40 has contacts labeled: i) high-voltage power HVP; ii) power reference REF; and iii) data-out DATA. Contacts HVP and REF of first connector 34 receive operating power for decorative LED light string 16. Conductors 42 and 43 provide electrical conduction of the received operating power to both power converter 36 and second connector 40. Second connector 40 thereby provides operating power to one or more additional decorative LED light string attached thereto.

Power converter 36 converts the received high-voltage power to a low-voltage DC power suitable for consumption by lighting elements 38A-38P. In some embodiments, the received high-voltage power is 120 VAC line power. In such embodiments, power converter 36 converts the received 120 VAC line power to the low-voltage DC power suitable for consumption by lighting elements 38A-38P. In some embodiments, the received high-voltage power is a high-voltage DC power. For example, in an exemplary embodiment, power supply (depicted in FIG. 1) converts 120 VAC line power to high-voltage DC power by rectifying and filtering the 120 VAC line power. In such embodiments, power converter 36 converts the received high-voltage DC power to the low-voltage DC power suitable for consumption by lighting elements 38A-38P. In still other embodiments, power converter 36 is configured to convert power from other high-voltage power specifications to the low-voltage DC power suitable for consumption by lighting elements 38A-38P.

In the depicted embodiment, power converter 36 provides the low-voltage DC power suitable for consumption by lighting elements 38A-38P on conductor 44. In the depicted embodiment, the converted low-voltage DC power provided to conductor 44 is referenced to power reference REF of conductor 42. Conductors 43 and 44 provide the converted low-voltage DC power to each of lighting elements 38A-38P. In some embodiments, the converted low-voltage DC power will have an isolated reference, independent of power reference REF of conductor 43. In such embodiments, an additional conductor will provide the isolated reference voltage to lighting elements 38A-38P. In such embodiments, the additional conductor along with conductor 44 can provide the converted low-voltage DC power to each of lighting elements 38A-38P.

Lighting elements 38A-38P are identical to one another in the depicted embodiment. Lighting elements 38A-38P are wired in daisy chain fashion from the data-in contact of first connector 34 to the data-out contact of second connector 40 via data-in DI and data-out DO ports of lighting elements 38A-38P. First connector 34 receives illumination control data on the data-in contact of first connector 34. The received illumination control data can independently control the illumination of each of lighting elements 38A-38P, as well as independently controlling lighting elements of one or more decorative LED light strings attached to second connector 40. The received illumination control data may include brightness control, color control, and/or temporal control (e.g., flashing or other temporal lighting variations).

Each of daisy-chained lighting elements 38A-38P receives the illumination control data at data-in port DI. Each of daisy-chained lighting elements 38A-38P then process the received illumination control data and control the illumination based on the received illumination control data. The received illumination control data includes data corresponding to the lighting element that receives the data as well as data corresponding to lighting elements downstream the daisy chain of lighting elements from the lighting element that receives the data. Thus, each of the daisy-chained lighting elements 38A-38P transmits at least some of the received illumination data to downstream lighting elements via the data-out port DO of the lighting element.

Figure 3:
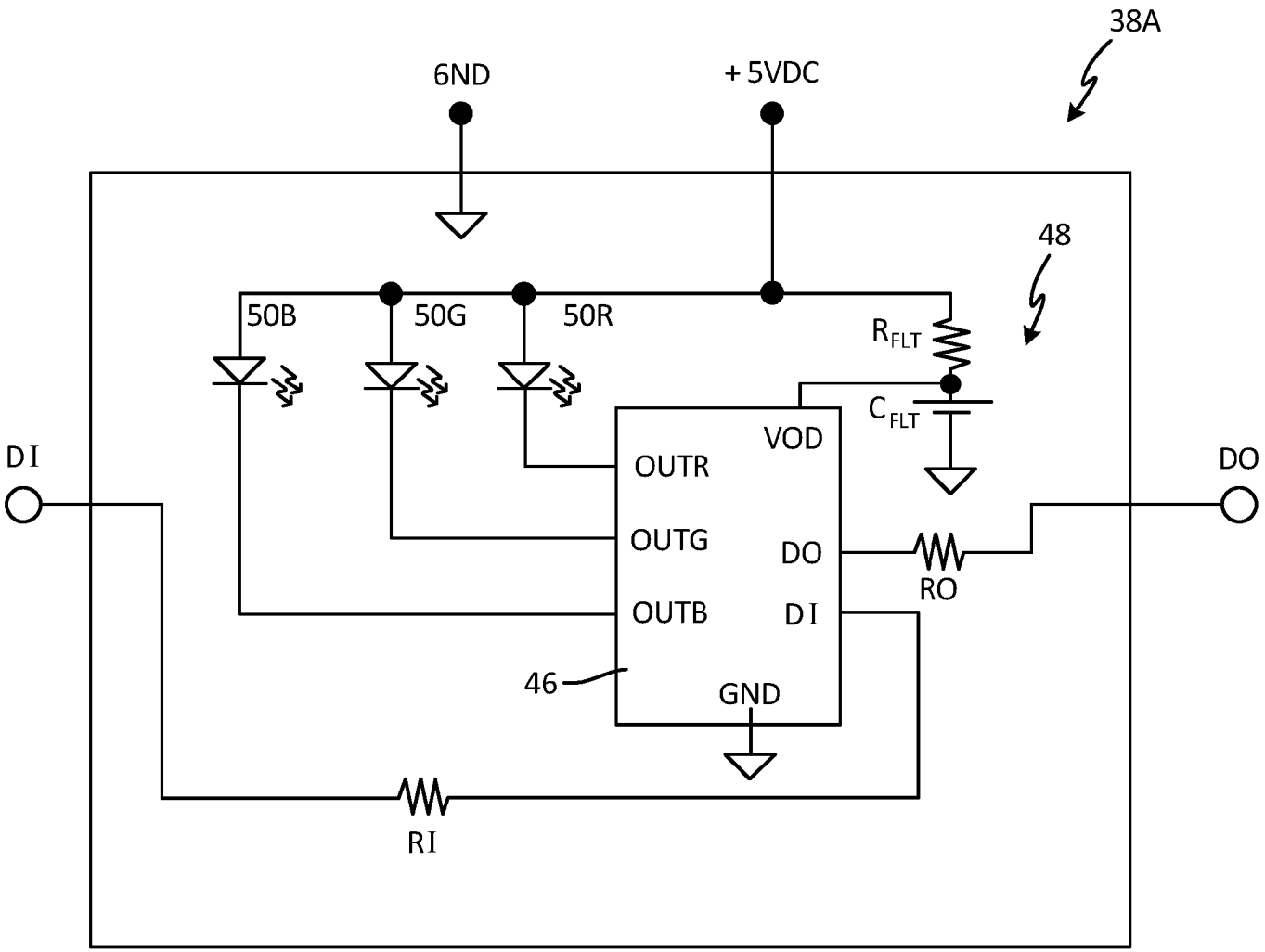
FIG. 3 is a circuit schematic diagram of an exemplary lighting element of a long-chain-tolerant decorative LED light string.

FIG. 3 is a circuit schematic diagram of an exemplary lighting element of a long-chain-tolerant decorative LED light string. In FIG. 3, lighting element 38A of FIG. s is shown in schematic form. Lighting element 38A includes data-in port DI, data-out port DO, ground port GND, low-voltage DC, and power port +5 VDC. Lighting element 38A also includes illumination controller 46, resistors RI and RO, power filter 48, and LEDs 50R, 50G and 50B. In the depicted embodiment, power filter 40 includes resistor $R_{FLT}$ and capacitor $C_{FLT}$. In various embodiments, various power filters can be used. For example, in some embodiments, an inductor can be used in addition to or replacing resistor $R_{FLT}$. In an exemplary embodiment, no power filter is used.

Illumination controller 46 has pins: i) power VDD; ii) ground GND; iii) data-in DI; iv) data-out DO; v) red LED control OUTR; vi) green LED control OUTG; and vii) blue LED control OUTB. LEDs 50R, 50G and 50B each have cathodes that are electrically connected both to one another and to the low-voltage DC power (e.g., +5 VD in the depicted embodiment). Illumination controller 46 controls currents flowing through each of LEDs 50R, 50G and 50B via control pins OUTR, OUTG and OUTB, respectively. Illumination controller 46 controls the currents flowing through LEDs 50R, 50G and 50B based on the illumination control data received on the data-in port DI of lighting element 38A and electrically conducted to the data-in pin DI of illumination controller 46.

In various embodiments, lighting elements 38A-38P can include various configurations of LEDs. For example, in an exemplary embodiment lighting elements 38A-38P can include a red LED, a green LED, and a blue LED. In some embodiments, lighting elements 38A-38P can include other types of LEDs, such as, for example, warm white, pure white, ultra-violet (UV), deep blue, and/or amber LEDs. Such types of LEDs can be including alone or in various combinations in lighting elements 38A-38P.

In various embodiments, illumination controller 46 controls the illumination color, brightness, temporal pattern of illumination. For example, illumination controller 46 can control color by controlling the relative intensities of the red, green and blue light illuminated by LEDs 50R, 50G and 50B, respectively. Illumination controller 46 can control brightness by controlling the absolute intensity of the combination of red, green and blue light illuminated by LEDs 50R, 50G and 50B, respectively. Illumination controller 46 can control the temporal pattern of illumination by temporally changing these relative and absolute intensities as a function of time.

Figure 4:
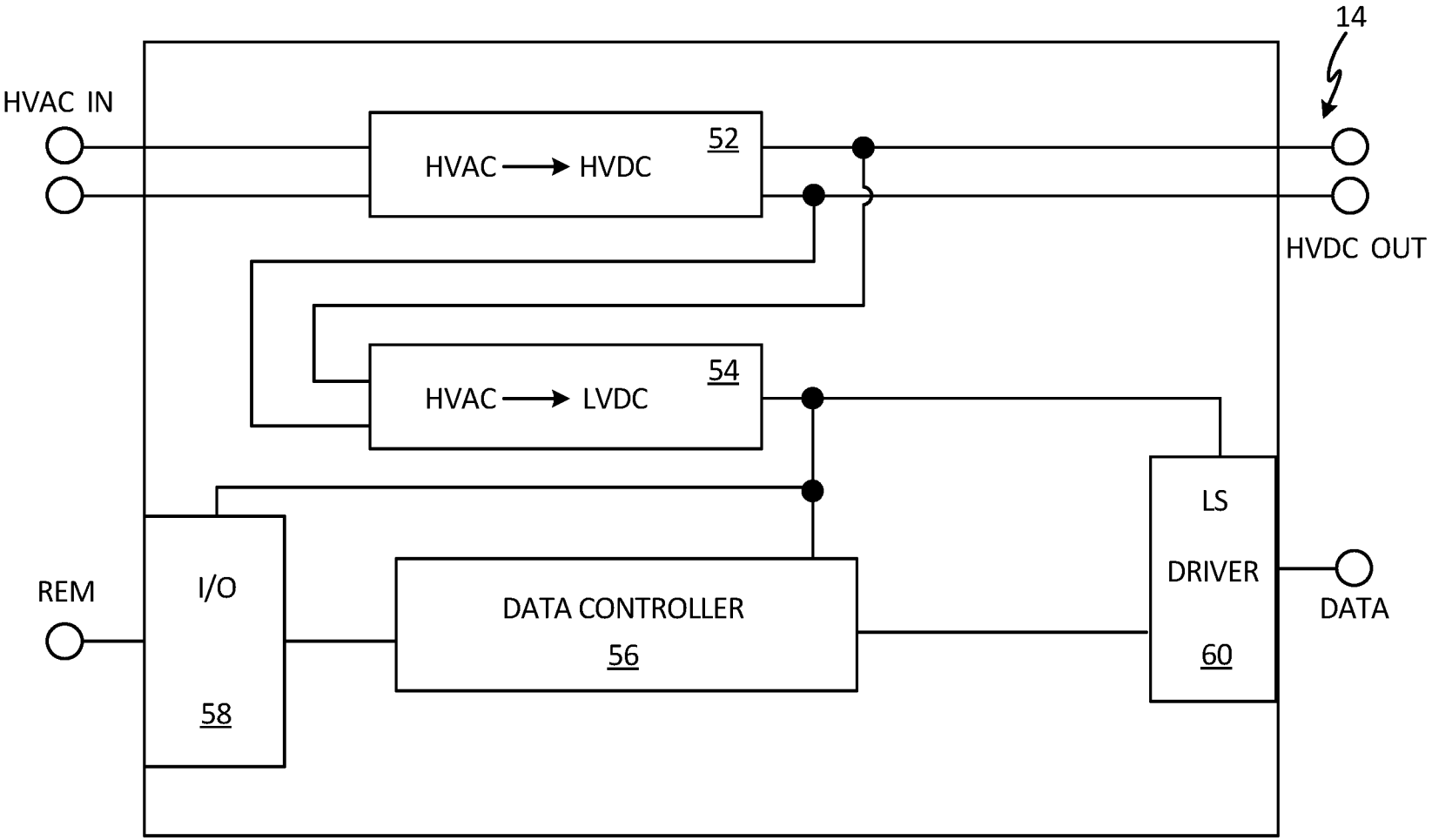
FIG. 4 is a circuit schematic of an exemplary power supply for a long chain of decorative LED light strings.

FIG. 4 is a block schematic of an exemplary power supply for a long chain of decorative LED light strings. In FIG. 4, exemplary power supply 14 depicted in FIG. 1 is shown in block diagram form. Power supply 14 high-voltage AC/high-voltage DC converter, 52, high-voltage DC/low-voltage DC converter 54, data controller 56, input/output interface 58 and light-string driver 60. Power supply 14 also has high-voltage AC input port HVAC_IN, high-voltage DC output port HVDC_OUT, remote data input port REM, and light-string data output port DATA.

High-voltage AC/high-voltage DC converter 52 received high-voltage AC power from high-voltage AC input port HVAC_IN. High-voltage AC/high-voltage DC converter 52 converts the received high-voltage AC power to high-voltage DC power and provide the converted high-voltage DC power to a connected chain of light strings via high-voltage DC output port HVDC_OUT, and provides the converted high-voltage DC power to high-voltage DC/low-voltage DC converter 54. High-voltage DC/low-voltage DC converter 54 converts the received high-voltage DC power to low-voltage DC power and provides the converted low-voltage DC power to each of data controller 56, input/output interface 58 and light-string driver 60.

Data controller 56 generates an illumination control signal and provides it to the connected chain of light strings via light-string data output port DATA. Data controller may store data corresponding to various illumination patterns, and/or may receive various illumination patterns from a remote pattern generator via input/output interface 58.

Figure 5:
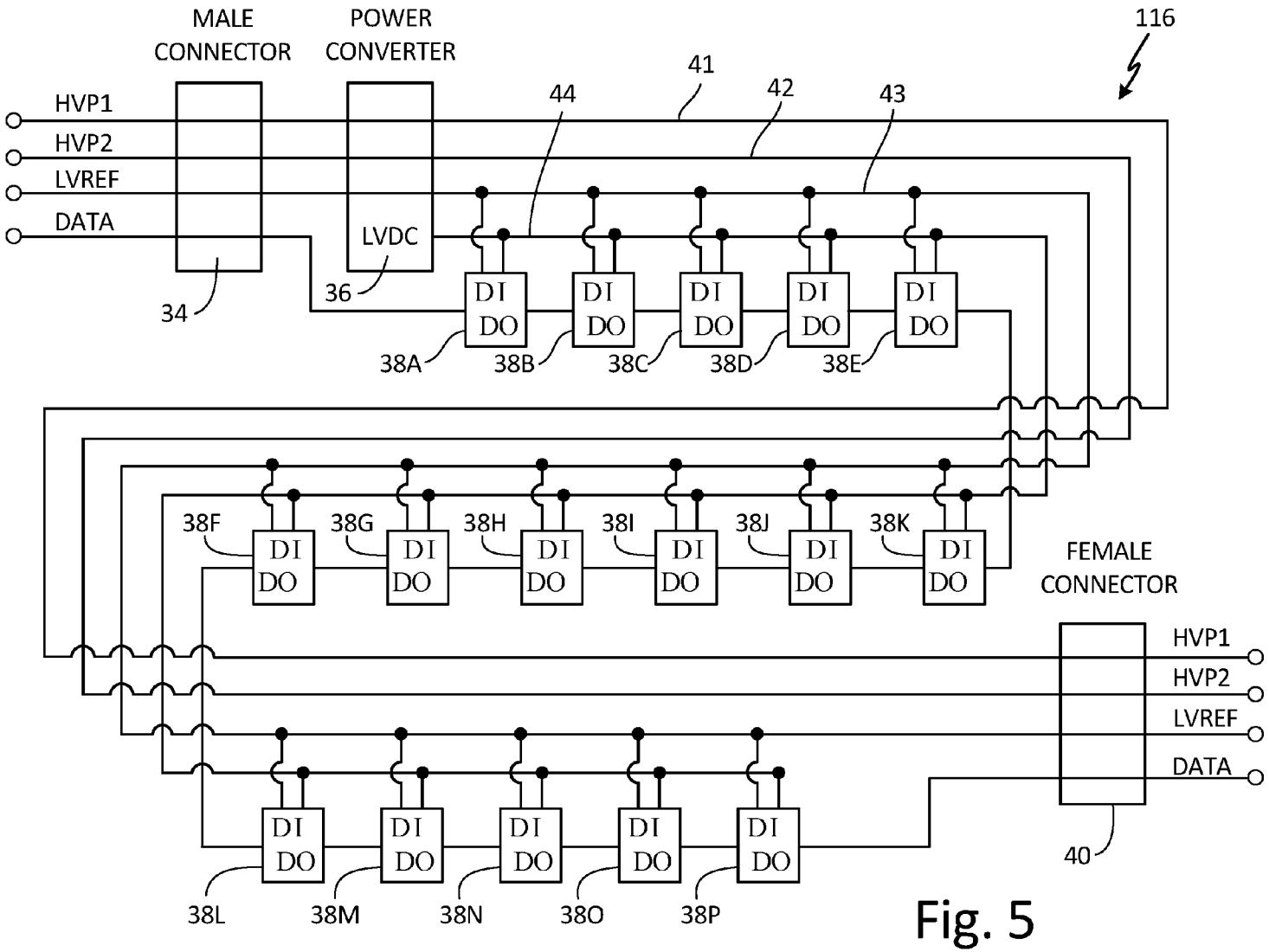
FIG. 5 is a schematic diagram of an exemplary long-chain-tolerant decorative LED light string with separate high-voltage and low-voltage references.

FIG. 5 is a schematic diagram of an exemplary long-chain-tolerant decorative LED light string with separate high-voltage and low-voltage references. Decorative LED light sting 116 depicted in FIG. 5 is the same as Decorative LED light string 16 shown in FIG. 2, except that it has one additional electrical conductor. In the depicted embodiment connectors 34 and 40 each has four contacts. First connector 34 has contacts labeled: i) first high-voltage power HVP1; ii) second high-voltage power HVP2; iii) low-voltage reference LVREF; and iv) and data-in DATA. Second connector 40 has contacts labeled: i) first high-voltage power HVP1; ii) second high-voltage power HVP2; iii) low-voltage reference LVREF; and iv) data-out DATA. Contacts HVP1 and HVP 2 of first connector 34 receive operating power for decorative LED light string 16. Conductors 41 and 42 provide electrical conduction of the received high-voltage operating power to both power converter 36 and second connector 40. Second connector 40 thereby provides operating power to one or more additional decorative LED light string attached thereto.

Power converter 36 converts the received high-voltage power to a low-voltage DC power suitable for consumption by lighting elements 38A-38P. In some embodiments, the received high-voltage power is 120 VAC line power. In such embodiments, power converter 36 converts the received 120 VAC line power to the low-voltage DC power suitable for consumption by lighting elements 38A-38P. In some embodiments, the received high-voltage power is a high-voltage DC power. For example, in an exemplary embodiment, power supply (depicted in FIG. 1) converts 120 VAC line power to high-voltage DC power by rectifying and filtering the 120 VAC line power. In such embodiments, power converter 36 converts the received high-voltage DC power to the low-voltage DC power suitable for consumption by lighting elements 38A-38P. In still other embodiments, power converter 36 is configured to convert power from other high-voltage power specifications to the low-voltage DC power suitable for consumption by lighting elements 38A-38P.

In the depicted embodiment, power converter 36 provides the low-voltage DC power suitable for consumption by lighting elements 38A-38P on conductors 43 and 44. In the depicted embodiment, the converted low-voltage DC power provided to conductors 43 and 44 is referenced to power reference REF of conductor 43. Conductors 43 and 44 provide the converted low-voltage DC power to each of lighting elements 38A-38P. In the depicted embodiment, the converted low-voltage DC power has an isolated reference from the high-voltage power received on conductors 41 and 42.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A decorative light string comprising:

a first electrical connector located at a first end of the decorative light string, the first electrical connector having first, second, and third contacts, wherein the first electrical connector is configured to receive high-voltage operating power on the first and second contacts, and is further configured to receive light-control data on the third contact;

a second electrical connector at a second end of the decorative light string, the second electrical connector having first, second, and third contacts, wherein the second electrical connector is configured to provide high-voltage operating power on the first and second contacts, and to provide light-control data on the third contact;

a first conductor electrically coupled to and extending from the first contact of the first electrical connector to the first contact of the second electrical connector;

a second conductor electrically coupled to and extending from the second contact of the first electrical connector to the second contact of the second electrical connector;

a power converter configured to convert the high-voltage operating power received by the first and second contacts of the first electrical connector to a low-voltage DC operating power; and a plurality of lighting elements distributed along the decorative light string, the plurality of lighting elements wired in parallel and configured to receive the low-voltage DC operating power, each of the plurality of lighting elements having a data-in port and a data-out port, the plurality of lighting elements wired in a daisy-chain fashion, via the data-in and data-out ports from the data-in pin of the first electrical connector to the data-out pin of the second electrical connector.

2. The decorative light string of claim 1, wherein the controller of each lighting element includes a controller to receive a data-in signal at the data-in port of the lighting element and to provide a data-out signal to the data-out port of the lighting element.

3. The decorative light string of claim 2, wherein each of the plurality of lighting elements includes a red LED, a green LED, and a blue LED.

4. The decorative light string of claim 3, wherein each of the plurality of lighting elements further includes an additional LED selected from the group consisting of: a warm white LED; a pure white LED; an amber LED; an Ultra-Violet (UV) LED; and a deep blue LED.

5. The decorative light string of claim 3, wherein the controller of each of the plurality of lighting elements is configured to control, in response to the received data-in signal, brightness of each of the red, green, and blue LEDs of the lighting element.

6. The decorative light string of claim 3, wherein the controller of each of the plurality of lighting elements is configured to control, in response to the received data-in signal, a temporal behavior of each of the red, green and blue LEDS of the lighting element.

7. The decorative light string of claim 3, wherein the red LED of each lighting element has an anode electrically connected to the first low-voltage power conductor and a cathode electrically connected to the controller of the lighting element, wherein the green LED of each lighting element has an anode electrically connected to the first low-voltage power conductor and a cathode electrically connected to the controller of the lighting element, and the blue LED of each lighting element has an anode electrically connected to the first low-voltage power conductor and a cathode electrically connected to the controller of the lighting element.

8. The decorative light string of claim 1, wherein the first connector is a male connector and the second connector is a female connector complementary to the male connector.

9. The decorative light string of claim 1, wherein the high-voltage operating power has a DC voltage of greater than 100 volts.

10. The decorative light string of claim 1, wherein the high-voltage operating power has an AC voltage of greater than 100 volts.

11. The decorative light string of claim 1, wherein the plurality of lighting elements distributed along the decorative light string are arranged in an ordered sequence, the ordered sequence of lighting elements receiving the low-voltage operating power from the power converter, wherein a first lighting element of the ordered sequence of lighting elements is configured to receive a data signal provided to the data-in contact of the first connector, wherein a last lighting element of the ordered sequence of lighting elements is configured to provide a data signal to the data-out pin of the second connector, wherein each lighting element of the ordered sequence between the first and the last lighting elements of the ordered sequence of lighting elements is configured to receive a data signal from a preceding adjacent lighting element and is further configured to supply a data signal to a succeeding adjacent lighting element.

12. The decorative light string of claim 1, wherein each of the first and second connectors consists of three electrical contacts for electrical connection thereto.

13. The decorative light string of claim 1, wherein the second low-voltage power conductor is shared with the second power conductor.

14. A method of providing power and data to one or more serially-connected light strings comprising:

receiving high-voltage operating power on first and second power-in contacts of a first connector of a decorative light string;

receiving data on a data-in contact of a first connector;

providing the received high-voltage operating power on the first and second power-out contacts of a second connector of the light string;

providing data on the data-out contact of the second connector;

converting the high-voltage operating power received by the first and second power-in contacts to a low-voltage DC operating power;

providing the converted low-voltage DC operating power to each of a plurality of lighting elements; and independently controlling illumination of a plurality of lighting elements distributed along the decorative light string.

15. The method of claim 14, further comprising daisy-chaining, via a data-in port and a data-out port, the plurality of lighting elements from the data-in pin of the first connector to the data-out pin of the second connector.

16. The method of claim 14, wherein independently controlling the brightness of the plurality of lighting elements distributed along the decorative light string comprises independently controlling color of the plurality of lighting elements distributed along the decorative light string.

17. The method of claim 14, wherein independently controlling the brightness of the plurality of lighting elements distributed along the decorative light string comprises independently controlling intensity of the plurality of lighting elements distributed along the decorative light string.

18. The method of claim 14, wherein independently controlling the brightness of the plurality of lighting elements distributed along the decorative light string comprises independently controlling a temporal pattern of the plurality of lighting elements distributed along the decorative light string.

19. The method of claim 14, wherein independently controlling illumination of a plurality of lighting elements distributed along the decorative light string comprises passing independent illumination control data to each of the plurality of lighting elements via the daisy chain.

20. A decorative light strings comprising:

first and second electrical connectors located at first and second ends, respectively of the decorative light string, each of the first and second electrical connectors having first, second, and third contacts;

first and second conductors electrically coupled to and extending from the first and second contacts of the first electrical connector to the first and second contacts of the second electrical connector, respectively;

a power converter configured to convert a high-voltage operating power received by the first and second contacts of the first electrical connector to a low-voltage DC operating power; and a plurality of lighting elements distributed along the decorative light string receiving the low-voltage DC operating power and wired in daisy chain fashion from the third contact of the first electrical connector to the third contact of the second electrical connector via a data-in and a data-out port of each lighting element.

21. The decorative light string of claim 20, wherein the controller of each lighting element includes a controller to receive a data-in signal at the data-in port of the lighting element and to provide a data-out signal to the data-out port of the lighting element.

22. The decorative light string of claim 20, wherein each of the plurality of lighting elements includes a red LED, a green LED, and a blue LED.

23. The decorative light string of claim 22, wherein each of the plurality of lighting elements further includes an additional LED selected from the group consisting of: a warm white LED; a pure white LED; an amber LED; an Ultra-Violet (UV) LED; and a deep blue LED.

* * * * *